US005158438A

United States Patent [19]

Olson et al.

[11] Patent Number: 5,158,438

[45] Date of Patent: Oct. 27, 1992

[54] QUICK MOUNT PUMP FRAME

[75] Inventors: Andrew Olson, Villa Park; Lawrence Kelly, Bolingbrook, both of Ill.

[73] Assignee: Graco Inc., Minneapolis, Minn.

[21] Appl. No.: 739,891

[22] Filed: Aug. 2, 1991

[51] Int. Cl.[5] ..... F04B 17/00

[52] U.S. Cl. ..... 417/360; 417/361; 417/429

[58] Field of Search ..... 417/426, 429, 360, 361, 417/363

[56] References Cited

U.S. PATENT DOCUMENTS

| | | | |
|---|---|---|---|
| 2,752,989 | 7/1956 | Jenkins, Jr. | 158/36.4 |
| 2,925,780 | 2/1960 | Tear | 417/429 |
| 3,196,802 | 7/1965 | Matheny | 103/218 |
| 3,207,378 | 9/1965 | Trumbull et al. | 222/134 |
| 3,610,783 | 10/1971 | Croucher | 417/390 |
| 3,612,732 | 10/1971 | Stephans | 417/426 |
| 3,642,175 | 2/1972 | Robbins | 222/135 |
| 3,871,268 | 3/1975 | Misima | 92/13.3 |
| 4,189,070 | 2/1980 | Macosko et al. | 222/134 |
| 4,509,903 | 4/1985 | Fram | 417/464 |
| 4,634,024 | 1/1987 | Vollenweider | 417/62 |

FOREIGN PATENT DOCUMENTS 2247951 4/1974 Fed. Rep. of Germany ..... 417/426

OTHER PUBLICATIONS

"Variable Ratio Hydra Cat® Proportioning Pump", Instructions—Parts List #307-399, Revision G, Graco Inc., P.O. Box 1441, Minneapolis, Minn. 55440-1441, 1980.

*Primary Examiner*—Richard A. Bertsch
*Assistant Examiner*—Charles Freay
*Attorney, Agent, or Firm*—Douglas B. Farrow

[57] ABSTRACT

An easily adjustable and serviceable plural component pumping system has a frame assembly with a pivotable drive beam. The drive beam passes through spherical rod bearings in the connecting rod of two positive displacement pumps. The pumps are mounted to the frame via hand tightenable clamps so that by loosening the clamp the pumps may be slid along the frame to vary the ratio or remove for servicing without the need for too.

3 Claims, 3 Drawing Sheets

QUICK MOUNT PUMP FRAME

BACKGROUND OF THE INVENTION

Equipment for pumping plural component materials is old and well known. Such units have been sold by any number of companies including those sold by Graco Inc. under the trademark Variable Ratio Hydracat. In such units, typically one air motor is used to drive a plurality of pumps having some sort of a balance beam assembly between them to vary the ratio fo fluids pumped, the pumps being positive displacement piston type pumps. Such assemblies, while functioning well for their intended use, are often difficult to adjust in terms of changing the ratio or disassembling to replace a pump or otherwise service one of the assemblies.

It is therefore an object of this invention to provide a plural component dispensing unit which will function well and which may be easily adjusted without tools and serviced in the same manner.

It is further an object of this invention to produce a unit which is flexible in application and mounting.

SUMMARY OF THE INVENTION

A bent sheet metal frame shroud combination houses a main pivot support on one end and two pump support clamps. Each pump support clamp is comprised of an upper and lower rail joined by two locking screws such that the screws can be tightened pinching a pump mounting plate between the individual rails. By loosening the locking screws, the pump mounting plates can be positioned or removed from along the rails. Suspended from each of the two pump mounting places there is a positive displacement reciprocating pump.

A reciprocating drive air motor is attached above one of the pump mounting plates. Its displacement rod extends through the pump displacement rod by means of a connecting rod. A second connecting rod is attached to the remaining pump displacement rod. Each connecting rod houses a spherical bearing. Attached to the main pivot support is a third spherical bearing and a round drive beam. The round drive beam extends along the length of the frame in line with the axis of the pump support clamps and at the intersection of each pump, the drive beam passes through the spherical bearing of each connecting rod.

In operation then, the main motor reciprocates and this motion is transferred directly to the master pump which is coupled to the motor and secondarily to the slave pump by means of the drive beam. Stroke length of the slave pump is dependent upon location of the slave pump between the main pivot point and the master pump. By controlling the slave pump stroke length in relation to that of the master pump, the relative output or ratio of the displaced fluids can be controlled. This construction allows ratio adjustment or pump removal to be accomplished without tools through manual manipulation of the clamps.

Each pump may be removed from the mechanism easily by stopping the drive beam in mid-stroke and loosening the clamp. In this condition, the pump is allowed to slide off the mounting rail and drive beam. Since the pumps are freely suspended from the frame, the pump inlets are available for service and may be immersed directly into a fluid. By using spherical bearing points which compensate for the angular and linear movement of the pump connection, only three bearing points are required.

These and other objects and advantages of the invention will appear more fully from the following description made in conjunction with the accompanying drawings wherein like reference characters refer to the same or similar parts throughout the several views.

A BREIF DESCRIPTION OF THE DRAWINGS

DESCRIPTON OF THE PREFERRED EMBODIMENT

Figure 1:
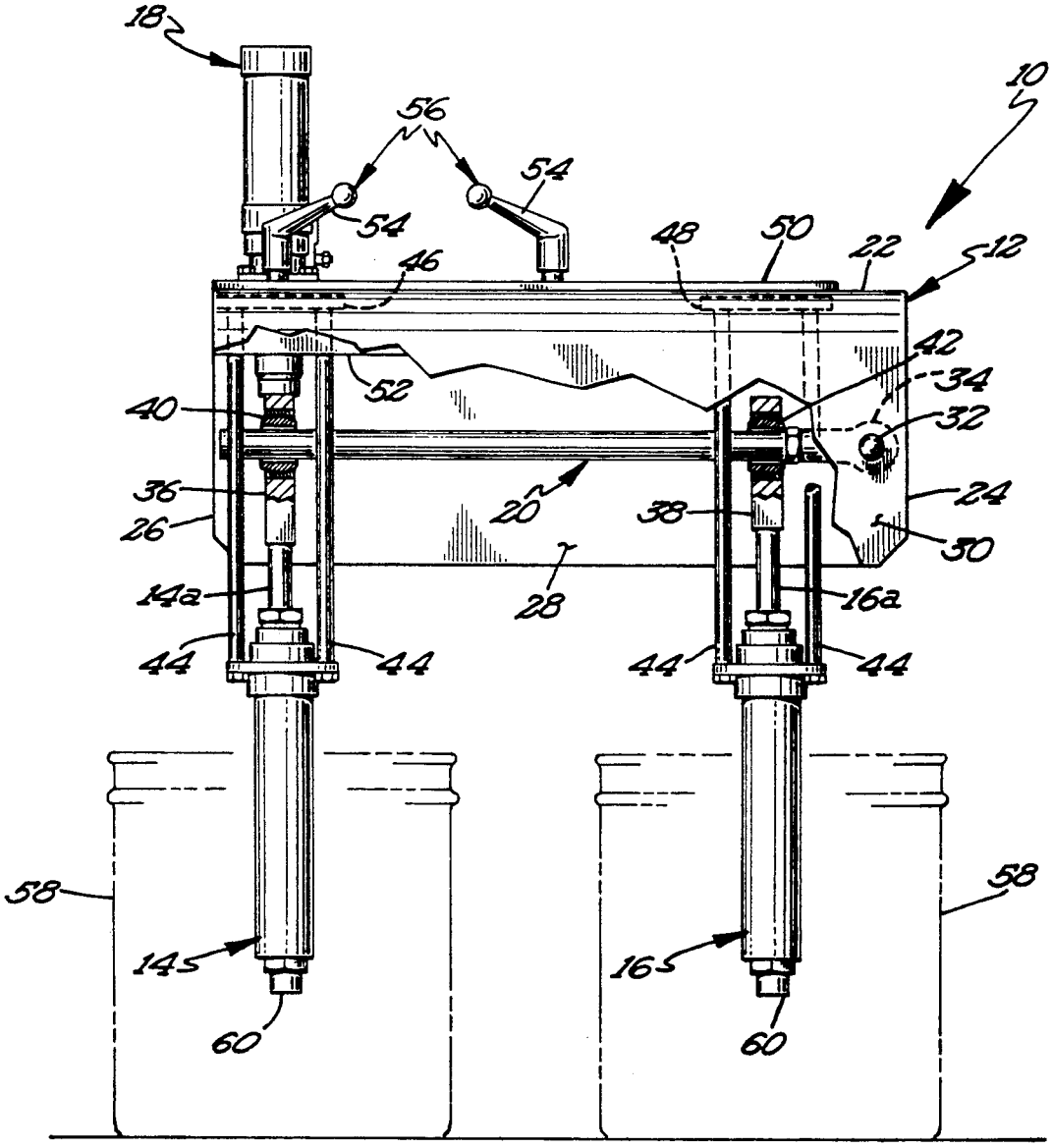
FIG. 1 is a side view partially cut away showing the device of the instant invention.

The quick mount plural dispensing plural component pump frame of the instant invention, generally designated 10 is comprised broadly of a frame 12, a master pump 14, a slave pump 16, an air motor 18 and a drive beam 20. Frame 12 is comprised generally of a top 22, first and second ends 24 and 26 respectively and first and second sides 28 and 30 respectively.

Main pivot support 32 extends between first and second sides 28 and 30. Drive beam 20 has a spherical bearing 34 through which passes main pivot support 32. Master and slave pumps 14 and 16 respectively each have connecting rods 36 and 38 respectively attached to the upper ends of pump displacement rods **14*a* and 16*a* respectively. Connecting rods 36 and 38 each have located therein spherical bearings 40 and 42 respectively through which passes through drive beam 20**.

A plurality of tie rods 44 connect pumps 14 and 16 to mounting plates 46 and 48 respectively. Air motor 18 for master pump 14 is mounted to mounting plate 46. As can best be seen in FIG. 2, main pivot support 32 extends between first and second sides 28 and 30 respectively. Upper and lower rails 50 and 52 respectively are clamped together by means of lock screws 54 each of which has a radially extending handle 56 providing leverage sufficient to tighten lock screw 54 so as to clamp mounting plates 46 or 48 therebetween.

Figure 2:
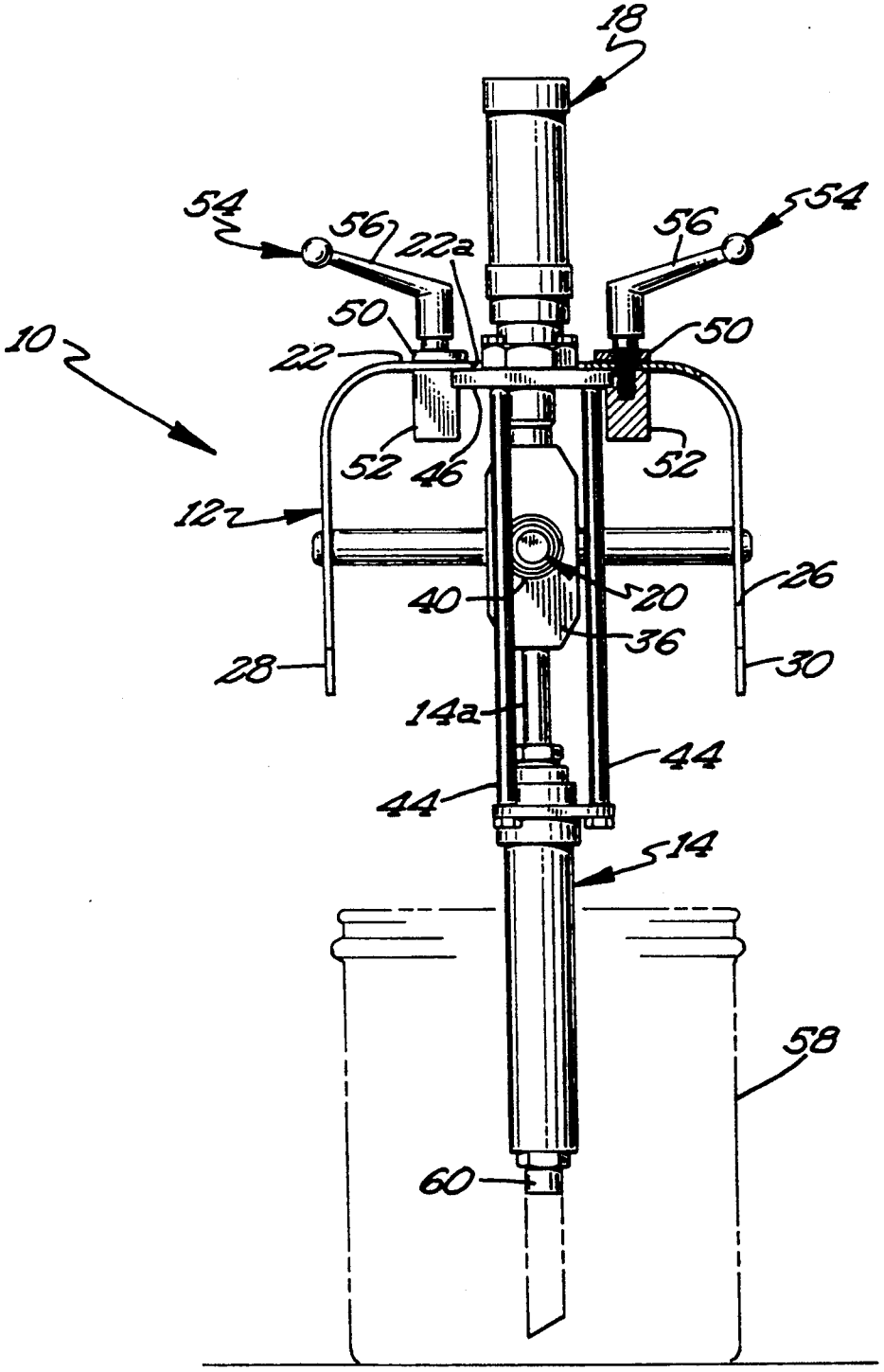
FIG. 2 is an end view showing the device of the instant invention.

Frame 12 may be attached at first end 24 to some sort of a stand or attached to the wall and as can be seen in FIG. 2, the lower end of the pumps may extend into a container 58 of material to be pumped. Alternatively of course, plumbing may run from the inlets 60 of the pumps to the respective material supplies.

Figure 3:
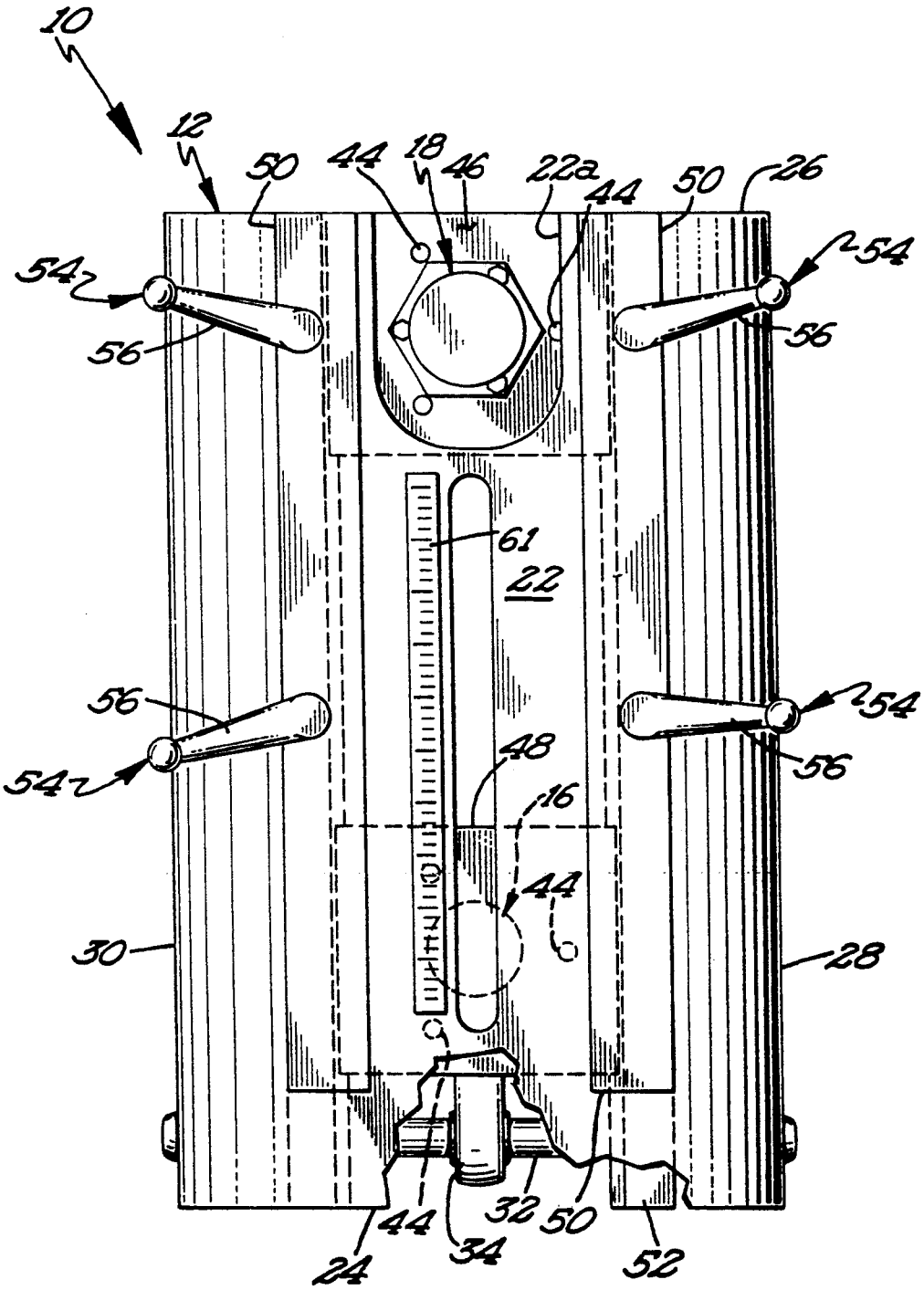
FIG. 3 is a top view showing the instant invention.

As can be seen in FIG. 3, a slot **22*a* is located in second end 26 of top 22 for receiving air motor 18. Upper rails 50 serve to held reinforce the clamping provided by locking screws 54 and the slave pump 16 may be positioned using the rule 60 provided on top 22**.

It is contemplated that various changes and modifications may be made to the quick mount plural dispensing plural component pump frame without departing from the spirit and scope of the invention as defined by the following claims.

What is claimed is:

1. An easily adjustable plural component pumping system comprising:

a frame having first and second ends, a slot in said frame top extending from an opening in said first end toward said second end, a top and first and second sides;

a drive beam pivotably attached to said frame adjacent one of said ends;

at least two reciprocating pump units, each said pump unit comprising;

a positive displacement pump;

a plurality of tie rods extending from said pump;

a mounting plate attached to said tie rods: and a connecting rod attached to said pump, each said connecting rod being slideably located on said drive beam;

a motor attached to one of said connecting rods, said motor being located in said slot;

a lower rail attached to said clamping means and sandwiching said mounting plate with said frame top; and means manually operable clamping each said pump unit to said frame top.

2. The plural component pumping system of claim 1 further comprising a spherical bearing in each said connecting rod, said drive beam extending through each said bearing.

3. The plural component pumping system of claim 1 wherein said clamping means comprises a plurality of locking screws having manually operable handles.

* * * * *